US011103118B2

(12) United States Patent
Leuchten et al.

(10) Patent No.: US 11,103,118 B2
(45) Date of Patent: Aug. 31, 2021

(54) METHOD OF MANUAL SURFACE CLEANING USING CLEANING TEXTILES AND OF WASHING SAID CLEANING TEXTILES

(71) Applicant: ECOLAB USA INC., St. Paul, MN (US)

(72) Inventors: Elke Leuchten, Solingen (DE); Thomas Hansen, Grevenbroich (DE); Freek Schepers, Düsseldorf (DE)

(73) Assignee: ECOLAB USA INC., St. Paul, MN (US)

( * ) Notice: Subject to any disclaimer, the term of this patent is extended or adjusted under 35 U.S.C. 154(b) by 124 days.

(21) Appl. No.: 15/329,551

(22) PCT Filed: Aug. 1, 2014

(86) PCT No.: PCT/EP2014/066575
§ 371 (c)(1),
(2) Date: Jan. 26, 2017

(87) PCT Pub. No.: WO2016/015778
PCT Pub. Date: Feb. 4, 2016

(65) Prior Publication Data
US 2017/0209016 A1 Jul. 27, 2017

(51) Int. Cl.

| | |
|---|---|
| ***A47L 13/17*** | (2006.01) |
| ***C11D 17/00*** | (2006.01) |
| ***A47L 13/256*** | (2006.01) |
| ***D06F 35/00*** | (2006.01) |
| ***C11D 17/04*** | (2006.01) |

(52) U.S. Cl.
CPC ..... *A47L 13/17* (2013.01); *A47L 13/256* (2013.01); *C11D 17/049* (2013.01); *D06F 35/006* (2013.01)

(58) Field of Classification Search
None
See application file for complete search history.

(56) References Cited

U.S. PATENT DOCUMENTS

| | | | | |
|---|---|---|---|---|
| 2,261,738 | A * | 11/1941 | Jones | A47L 13/502 15/311 |
| 2,674,619 | A | 4/1954 | Lundsted | |
| 2,677,700 | A | 4/1954 | Jackson et al. | |
| 2,903,486 | A | 9/1959 | Brown et al. | |
| 3,048,548 | A | 8/1962 | Martin et al. | |
| 3,382,178 | A | 5/1968 | Lissant et al. | |
| 3,929,678 | A | 12/1975 | Laughlin et al. | |
| 4,261,868 | A | 4/1981 | Hora et al. | |
| 4,435,307 | A | 6/1984 | Barbesgaard et al. | |
| 4,565,647 | A | 1/1986 | Llenado | |
| 5,234,610 | A | 8/1993 | Gardlik et al. | |
| 5,609,255 | A * | 3/1997 | Nichols | A47L 13/20 15/144.3 |
| 6,017,872 | A | 1/2000 | Pedersen et al. | |
| 6,060,299 | A | 5/2000 | Sreekrishna et al. | |
| 6,579,839 | B2 | 6/2003 | Price et al. | |
| 2004/0019998 | A1 * | 2/2004 | Sander | A47J 47/18 15/261 |
| 2009/0090139 | A1 * | 4/2009 | Deppermann | D06F 39/02 68/17 A |
| 2012/0241389 | A1 * | 9/2012 | Van Landingham, Jr. | A47L 13/51 210/798 |
| 2014/0000653 | A1 * | 1/2014 | Sacks | A47L 13/17 134/6 |
| 2014/0011726 | A1 | 1/2014 | Mitchell et al. | |

FOREIGN PATENT DOCUMENTS

| | | | |
|---|---|---|---|
| EP | 0 130 756 | A1 | 1/1985 |
| EP | 0 265 832 | A2 | 5/1988 |
| EP | 0 271 044 | A2 | 6/1988 |
| EP | 1 350 843 | A2 | 10/2003 |
| EP | 2 311 361 | A1 | 4/2011 |
| GB | 1 296 839 | A | 11/1972 |
| JP | 53-4671 | U | 1/1978 |
| JP | S53-020487 | A | 2/1978 |
| JP | 59-2283 | U | 1/1984 |
| JP | 2000-87092 | A | 3/2000 |
| JP | 2001-521981 | A | 11/2001 |
| JP | 2002-45588 | A | 2/2002 |
| JP | 2002-508789 | A | 3/2002 |
| JP | 2003-10589 | A | 1/2003 |
| JP | 2003-528164 | A | 9/2003 |
| JP | 3148951 | U | 3/2009 |
| JP | 2010-526187 | A | 7/2010 |
| JP | 2011-46925 | A | 3/2011 |
| JP | 2014-509906 | A | 4/2014 |
| WO | 91/06637 | A1 | 5/1991 |
| WO | 94/02597 | A1 | 2/1994 |
| WO | 95/10591 | A1 | 4/1995 |
| WO | 95/26393 | A1 | 10/1995 |

(Continued)

OTHER PUBLICATIONS

International Search Report and International Written Opinion of the International Searching Authority for corresponding International Patent Application No. PCT/EP2014/066575 dated Mar. 30, 2015, 8 pgs.

*Primary Examiner* — Mikhail Kornakov
*Assistant Examiner* — Pradhuman Parihar
(74) *Attorney, Agent, or Firm* — Merchant & Gould P.C.

(57) ABSTRACT

The present invention refers to a system and method of manual surface cleaning comprising: a) applying a first use solution of a first detergent composition to a cleaning textile; b) wet wiping a surface with cleaning textiles wetted with a first use solution of the first detergent composition; c) washing the cleaning textiles soiled in the previous step by washing in a second use solution of the first detergent composition; and d) wet wiping a surface with cleaning textiles obtained in the previous step. The present invention further refers to the use of the detergent composition for manual surface cleaning involving the use of cleaning textiles and for washing said cleaning textiles soiled by said manual surface cleaning.

10 Claims, No Drawings

(56) References Cited

FOREIGN PATENT DOCUMENTS

| | | | |
|---|---|---|---|
| WO | 96/23873 | A1 | 8/1996 |
| WO | 96/33267 | A1 | 10/1996 |
| WO | 98/51768 | A1 | 11/1998 |
| WO | 99/02663 | A1 | 1/1999 |
| WO | 99/20726 | A1 | 4/1999 |
| WO | 99/27083 | A1 | 6/1999 |
| WO | 01/23510 | A2 | 4/2001 |
| WO | 01/62903 | A1 | 8/2001 |
| WO | 02/099091 | A2 | 12/2002 |
| WO | 2004/053039 | A2 | 6/2004 |
| WO | 2008/137790 | A2 | 11/2008 |
| WO | 2012/099526 | A1 | 7/2012 |

* cited by examiner

METHOD OF MANUAL SURFACE CLEANING USING CLEANING TEXTILES AND OF WASHING SAID CLEANING TEXTILES

This application is a National Stage Application of PCT/EP2014/066575, filed 1 Aug. 2014, and which application is incorporated herein by reference. To the extent appropriate, a claim of priority is made to the above disclosed application.

FIELD OF THE INVENTION

This invention relates generally to a method of manual surface cleaning, in particular floor cleaning, using cleaning textiles and of washing said cleaning textiles.

Cleaning of surfaces generally is carried out by using cleaning textiles. In particular, one method of cleaning floor surfaces is with the use of cleaning textiles such as mops. Mops are widely used for numerous wet and dry applications. A mop, in particular a flat mop, is designed to pick up and collect unwanted material such as dirt, dust, etc., from a floor by moving the mop across the floor's surface. A mop can be designed to be used dry or wet. Mops generally work well to pick up dirt, dust, etc.

For cleaning objects a plurality of mops are used during a cleaning action. The soiled mops are then washed in a washing machine and dried in a tumble dryer either at the same location or at a laundry. When cleaning small objects only a few mops, for example 10 to 15, are required for the daily cleaning and therefore the investment of a standard household or professional washing machine is not cost-effective. The logistic to send the (few) dirty mops to a laundry is time intensive and comparably expensive. Further, the few mops will not be ready for use for the next daily cleaning. Therefore, the customer needs hold available more mops during the week than required for current/ongoing use. The customer needs to collect the dirty mops and store them until the end of the week to send them to a laundry for washing.

OBJECT OF THE INVENTION

Therefore the technical object was to provide a system or method for surface cleaning and washing the soiled textiles which overcomes the drawbacks of the state of art.

SUMMARY

The technical object is solved by a method of manual surface cleaning comprising the steps of:

a) wet wiping a surface with cleaning textiles wetted with a use solution of a detergent composition A;

b) washing the cleaning textiles soiled in step a) by mechanically and automatically washing in a use solution of the detergent composition A;

c) wet wiping a surface with cleaning textiles obtained in step b) and wetted with the use solution of the detergent composition A;

d) optionally repeating steps b) and c) at least once.

In a preferred method the mechanically and automatically washing according to step b) is carried out in a use solution of the detergent composition A having the same or different concentration as used in step a).

The advantage of the method according to the present invention is that time is saved for logistics as the cleaning textiles, i.e. the mops, do not have to be send to a laundry anymore. Cleaning textiles such as mops simply can be washed in a use solution of the same detergent composition (detergent composition A) which is used for surface cleaning, preferably floor cleaning. The inventors surprisingly have shown that the soiled cleaning textiles, such as mops, can be sufficiently cleaned by using the same detergent composition as used for surface cleaning, in particular floor cleaning.

Further preferred, the cleaning textiles obtained in step b) are soaked or wetted with the use solution of the detergent composition A in the same concentration of the use solution as used in step a) and are provided in step b) ready for the use according to step c).

In a further preferred embodiment the cleaning textiles obtained in step b) are soaked or wetted with the use solution of the detergent composition A in the same concentration of the use solution as used in step a) and are provided in step b) ready for the use according to step c), and wherein the cleaning textiles are not spun in order not to remove the use solution of the detergent composition A from the cleaning textile before carrying out step c).

It should be noted that in the method according to the present invention the cleaning textiles obtained in step b) are not dried after washing and before their use in step c).

A further advantage of the method of the present invention is that washed cleaning textiles or mops after washing are ready for use. No pre-impregnation or pre-wetting in a bucket and pressing are required either. In addition, no investment into a tumble dryer at the site of cleaning is required since according to the method of the present invention the cleaning textiles after washing are not dried until their re-use in surface cleaning, in particular floor cleaning.

In a particularly preferred method the mechanically and automatically washing according to step b) is carried out further in presence of a preserving agent. Preferably the preserving agent is chosen from amines, quaternary ammonium compounds, aldehydes, antimicrobial acids and salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolines and mixtures thereof. In another embodiment, the preserving agent preferably is a bleaching agent or bleaching composition. Suitable bleaching agents or bleaching compositions comprise at least a mixture of hydrogen peroxide, peracid and the corresponding acid. For example, a suitable bleaching composition comprises at least hydrogen peroxide, peroxyacetic acid and acetic acid.

In a further embodiment of the present invention the mechanically and automatically washing according to step b) is carried out in a washing machine having a maximum load of 2.0 kg dry weight. This means that the maximum capacity of such washing machines is 2.0 kg dry weight of laundry articles, for example cleaning textiles. Such washing machine may be equipped with any one or more or all of the following features: heating means for heating the washing liquid or the water from the water supply for preparing the washing liquid, a pump for removing the used washing liquid, a drum suitable for spinning of the laundry articles. However, the washing machine having a maximum load of 2.0 kg dry weight used in the method of the present invention may be constructed in a more simple form and therefore may not have all or none of such features.

In a further particularly preferred method the mechanically and automatically washing according to step b) is carried out at a temperature in a range from 5 to 45° C., preferably from 5 to 40° C., more preferred from 5 to 35° C., further preferred from 5 to 30° C., even further preferred from 5 to 25° C., still further preferred from 5 to 21° C. and most preferred from 5 to 18° C. In another particularly preferred method the mechanically and automatically washing according to step b) is carried out at a temperature in a range from 12 to 35° C. The inventors surprisingly have shown that the soiled cleaning textiles can be sufficiently cleaned at a comparably low temperature. Therefore, no investment into an expensive washing machine comprising heating means for heating the washing liquid or the water from the water supply for preparing the washing liquid at the site of cleaning is required. This also saves costs and energy. The initial temperature of the washing liquid due to the cold tap water used for preparing the washing liquid may raise during the washing step, because of the mechanical agitation and the heat produced by the stirring device. However, even at the end of the washing step the temperature of the washing liquid will be much lower compared to a washing procedure carried out in a household or professional washing machine.

In further preferred embodiments of the method the mechanically and automatically washing according to step b) is carried out for 0.5 to 12 hours, preferably from 1 to 8 hours, most preferred from 1 to 4 hours. As the cleaning textiles will not be used until the next day there is sufficient time for washing overnight. On the other side, as there is sufficient time to wash the cleaning textiles a lower temperature of the washing liquid may be selected.

In another embodiment of the present invention the mechanically and automatically washing according to step b) is carried out in a portable washing machine or countertop washing machine. There is a large diversity of portable or countertop washing machines available. Such portable or countertop washing machines are simple in structure, comprise only a few base features such as mechanical agitation of the washing liquid. In some embodiments the washing machine comprises a simple hose to remove the used washing liquid from the washing machine. In many cases such portable or countertop washing machines have no connection to the water pipe and/or have no heating means for heating the washing liquid. In some embodiments such washing machines are not provided with a drum and therefore spinning of the laundry articles is not possible. In some embodiments such washing machines are not provided with a pump in order to remove the used washing liquid from the washing machine. In other embodiments such washing machines have a maximum weight of 15 kg, preferably 10 kg, further preferred 8 kg and most preferred 5 kg.

The advantage of the use of a rather simple washing machine without most of the specific features of a conventional household or professional washing machine is that no investment into an expensive household or professional washing machine at the site of cleaning is required. That is because the cleaning textiles preferably are washed in a rather simple portable washing machine or countertop washing machine, which saves costs, energy and possibly also water.

It is particularly preferred that the detergent composition A is a liquid detergent composition. In alternative embodiments the detergent composition A may be in solid for such as powder form or tablet form.

The detergent composition A used in the method of the present invention comprises at least one surfactant or surfactant system. Surfactants suitable for use with the composition used in the method of the present invention include, but are not limited to, nonionic surfactants, anionic surfactants, zwitterionic surfactants and amphoteric surfactants. The term "surfactant" or "surfactant system" are used herein as synonyms. The "surfactant" or "surfactant system" used in the detergent composition A may represent a mixture of different surfactants, e.g. a mixture of different nonionic surfactants, or a mixture of different anionic surfactants, or a mixture of different zwitterionic surfactants or a mixture of different amphoteric surfactants or a mixture of one or more or all of the following nonionic surfactants, anionic surfactants, zwitterionic surfactants and amphoteric surfactants. Preferably, the detergent composition A comprises a surfactant selected from the group consisting of nonionic surfactants, anionic surfactants and zwitterionic surfactants and amphoteric surfactants.

In another preferred method the mechanically and automatically washing according to step b) is carried out further in presence of an alkalinity source. Typically, the detergent composition A comprises—besides the surfactant(s)—an alkalinity source.

In another preferred method the mechanically and automatically washing according to step b) is carried out further in presence of additional ingredients selected from the group consisting of soil release agents, anti-redeposition agents, enzymes, enzyme stabilizers, defoaming agents, optical brighteners, preserving agents, stabilizing agents such as chelating agents or sequestrants, and mixtures thereof. Typically, the detergent composition A comprises—besides the surfactant(s) and the alkalinity source—these additional ingredients selected from the group consisting of soil release agents, anti-redeposition agents, enzymes, enzyme stabilizers, defoaming agents, optical brighteners, preserving agents, stabilizing agents such as chelating agents or sequestrants, and mixtures thereof.

The present invention also provides the use of detergent composition A for manual surface cleaning, in particular floor cleaning, involving the use of cleaning textiles and for washing said cleaning textiles soiled by said manual surface cleaning, in particular floor cleaning, wherein the detergent composition A comprises at least one surfactant and the washing of said cleaning textiles is carried out in the presence of a preserving agent or preserving composition. The detergent composition A according to this use is as described above.

In particular, the present invention also refers to a system comprising the following a) to c):

a) detergent composition A;

b) one or more cleaning textiles;

c) a portable washing machine or countertop washing machine.

In a preferred embodiment of the system according to the present invention the detergent composition A is suitable for surface cleaning, in particular floor cleaning, and for washing of laundry articles including cleaning textiles. The detergent composition A used in the method according to the present invention is a bifunctional detergent composition as it is suitable for surface cleaning, in particular floor cleaning, and for washing of laundry articles including cleaning textiles.

It is particularly preferred that the detergent composition A is a liquid detergent composition.

In a particular preferred embodiment of the system of the present invention the detergent composition A comprises

- a surfactant selected from the group consisting of nonionic surfactants, anionic surfactants and zwitterionic surfactants and amphoteric surfactants; and
- an alkalinity source.

Further preferred, the detergent composition A of the system of the present invention comprises additional ingredients selected from the group consisting of soil release agents, anti-redeposition agents, enzymes, enzyme stabilizers, defoaming agents, optical brighteners, preserving agents, stabilizing agents such as chelating agents or sequestrants, and mixtures thereof.

As the inventors surprisingly have shown that the soiled cleaning textiles can be sufficiently cleaned at a comparably low temperature, no investment into an expensive washing machine comprising heating means for heating the washing liquid or the water from the water supply for preparing the washing liquid at the site of cleaning is required. Therefore, costs and energy are reduced.

As described before, the system comprises a portable washing machine or countertop washing machine. There is a large diversity of portable or countertop washing machines available. Such portable or countertop washing machines are simple in structure, comprise only a few base features such as mechanical agitation of the washing liquid. In some embodiments the washing machine comprises a simple hose to remove the used washing liquid from the washing machine. In many cases such portable or countertop washing machines have no connection to the water pipe and/or have no heating means for heating the washing liquid. In some embodiments such washing machines are not provided with a drum and therefore spinning of the laundry articles is not possible. In some embodiments such washing machines are not provided with a pump in order to remove the used washing liquid from the washing machine. In other embodiments such washing machines have a maximum weight of 15 kg, preferably 10 kg, further preferred 8 kg and most preferred 5 kg.

The advantage of the use of a rather simple washing machine without most of the specific features of a conventional household or professional washing machine is that no investment into an expensive household or professional washing machine at the site of cleaning is required. That is because the cleaning textiles preferably are washed in a rather simple portable washing machine or countertop washing machine, which saves costs, energy and possibly also water.

The advantage of the system according to the present invention is that the user saves time for logistics as the cleaning textiles, i.e. the mops, do not have to be send or brought to a laundry anymore. Mops simply can be washed in a use solution of the same detergent composition which is used for surface cleaning, in particular floor cleaning.

As described before, the washed cleaning textiles or mops are ready for use after washing. There is no requirement for pre-impregnation or pre-wetting in a bucket. Further, it is not necessary to invest in a tumble dryer at the site of cleaning, as according to the present invention the cleaning textiles after washing are not dried until their re-use in surface cleaning, in particular floor cleaning.

In a particularly preferred embodiment the system also comprises a preserving agent. It is particularly preferred that the cleaning textiles are washed by using the detergent composition A as described above and also in presence of a preserving agent. The system preferably comprises the preserving agent as a separate product, either in solid or liquid form. The preserving agent preferably is a bleaching agent or bleaching composition. Suitable bleaching agents or bleaching compositions comprise at least a mixture of hydrogen peroxide, peracid and the corresponding acid. For example, a suitable bleaching composition comprises at least hydrogen peroxide, peroxyacetic acid and acetic acid.

MODES FOR CARRYING OUT THE INVENTION

The present invention provides method of manual surface cleaning, in particular floor cleaning, comprising the steps of:

a) wet wiping a surface with cleaning textiles wetted with a use solution of a detergent composition A;

b) washing the cleaning textiles soiled in step a) by mechanically and automatically washing in a use solution of the detergent composition A;

c) wet wiping a surface with cleaning textiles obtained in step b) and wetted with the use solution of the detergent composition A;

d) optionally repeating steps b) and c) at least once.

The term "surface" used herein refers to a solid, substantially non-flexible surface such as a shower, sink, toilet, bathtub, counter top, tile, floor, wall, panel, window, mirror, plumbing fixture, kitchen and bathroom furniture, transportation vehicle and floor, preferably floor.

The detergent composition A, which is suitable for use in surface cleaning, in particular floor cleaning, and for use in washing the respective soiled cleaning textiles or mops, preferably is a liquid detergent composition. The detergent composition used in the present invention preferably comprises a surfactant. Further preferred the detergent composition A comprises an alkalinity source.

The detergent composition used in the method of the present invention may include other additional ingredients. Additional ingredients suitable for use with the compositions of the present invention include, but are not limited to, soil release agents, anti-redeposition agents, enzymes, enzyme stabilizers, defoaming agents, optical brighteners, preserving agents, stabilizing agents such as chelating agents or sequestrants, and mixtures thereof.

Surfactant System

Detergent composition A used in the present invention includes a surfactant system.

Surfactants suitable for use with the compositions in the method of the present invention include, but are not limited to, nonionic surfactants, anionic surfactants, zwitterionic surfactants and amphoteric surfactants. Preferred surfactants include non-ionic surfactants. In some embodiments, the compositions used in the method of the present invention include about 1% by weight to about 25% by weight, preferably 3% to about 20% by weight, and most preferably from about 5% by weight to about 15% by weight. When surfactants other than non-ionic surfactants are used, it is likely that a co-surfactant will be employed for improved cleaning capabilities.

Nonionic Surfactants

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surfactant. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronico® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

Nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Further effective low foaming nonionics include:

7. The alkylphenoxypolyethoxyalkanols of U.S. Pat. No. 2,903,486 issued Sep. 8, 1959 to Brown et al. and represented by the formula $R\text{-}Ph\text{-}(C_2H_4)_n(OA)_mOH$ in which R is an alkyl group of 8 to 9 carbon atoms, Ph is phenyl group, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O)_n(C_2H_4O)_mH]_x$, wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions according to this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present invention include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present invention. The alkyl chain of the aliphatic alcohol can either be straight or branched, primary or secondary, and generally contains from 6 to 22 carbon atoms.

10. The ethoxylated $C_1$-$C_{18}$ fatty alcohols and $C_1$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These nonionic surfactants may be at least in part represented by the general formulae:

$$R^{20}—(PO)_sN\text{-}(EO)_tH,$$

$$R^{20}—(PO)_sN\text{-}(EO)_tH(EO)_uH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}—(PO)_v—N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents was described supra.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Generally, however, anionics have high foam profiles which limit their use alone or at high concentration levels in cleaning systems such as CIP circuits that require strict foam control. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure $R_nX^+Y^-$ and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus: $(R)(R')(R'')N$, $(R)(R')(R'')N^+HX^-$, $(R)(R')(R'')N^+R'''X^-$, in which, R represents a long alkyl chain, R', R'', and R''' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions.

These desirable properties can include detergency in compositions of or below neutral pH, antimicrobial efficacy, thickening or gelling in cooperation with other agents, and the like.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation, for example with ethyl acetate. During alkylation, one or two carboxy-alkyl groups react to form a tertiary amine and an ether linkage with differing alkylating agents yielding different tertiary amines.

Commercially prominent imidazoline-derived amphoterics that can be employed in the present compositions include for example: Cocoamphopropionate, Cocoamphocarboxypropionate, Cocoamphoglycinate, Cocoamphocarboxyglycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R is $C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Cone, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is: $R^1Y^+(R^2)_x CH_2R^3Z^-$ wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl) ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated. The zwitterionic surfactant suitable for use in the present compositions includes a betaine of the general structure: $(R')(R'')(R''')N^+CH_2CO_2^-$, $(R')(R'')SCH_2CO_2^-$, $(R')(R'')(R''')P^+CH_2CO_2^-$ These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; $C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO_3^-$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

The surfactant preferably is present in the range of approximately 0.001 wt.-% to 1 wt.-% in cleaning solutions at use concentrations.

In a further preferred method the detergent composition A is used the concentrate thereof comprises based on the total concentrate 1 to 10 wt.-%, preferably 2 to 6 wt.-% of surfactant.

Alkalinity Source

The source of alkalinity can be any source of alkalinity that is compatible with the other components of the detergent composition A. Exemplary sources of alkalinity include alkali metal hydroxides, alkali metal salts, phosphates, amines, and mixtures thereof.

The detergent composition A can be adjusted so by adding the source of alkalinity that a pH-value about >=11 and about <=14, preferably of about >=12 and about <=13 is achieved. The pH-value is important to provide an optimized reduction in the germs count, such as bacteria, fungi, virus and spores.

Preferred alkali metal hydroxides include sodium hydroxide, potassium hydroxide, and lithium hydroxide. However, most preferred is sodium hydroxide. Alkali metal salts include sodium carbonate, trisodium phosphate, potassium carbonate, and mixtures thereof. Phosphates include sodium pyrophosphate, potassium pyrophosphate, and mixtures thereof. Amines include alkanolamine selected from the group comprising triethanolamine, monoethanolamine, diethanolamine, and mixtures thereof.

The source of alkalinity, preferably an alkali metal hydroxide, may be added to the composition in a variety of forms, including for example in the form of solid beads, dissolved in an aqueous solution or a combination thereof. Alkali metal hydroxides are commercially available as pellets or beads having a mix of particle sizes ranging from 12-100 U.S. mesh, or as an aqueous solution, as for example, as about 45 wt. %, about 50 wt. % and about 73 wt. % solution.

Soil Release Agents

Further preferred, the detergent composition A or the washing liquid used in step b) of the method of the present invention includes agents having the property to deliver a soil modifying property to soils.

Such agent may be selected from the group consisting of penetrants, pre-spotting agents, i.e. pre-treatment agents, HLB modifiers. The soils are modified by the agent in that way that the soils may be removed in a subsequent cleaning.

Soil release agents are preferably polymeric soil release agents, preferably those comprising block copolymers of polyalkylene terephthalate and polyoxyethylene terephthalate, and block copolymers of polyalkylene terephthalate and polyethylene glycol. Preferably, these polymeric soil release agents contain one, or more, negatively charged functional groups such as the sulfonate functional group, preferably as capping groups at the terminal ends of said polymeric soil release agent. Examples of soil release agents are provided in U.S. Pat. No. 5,234,610, which is herein incorporated by reference.

Soil Anti-Redeposition Agents

The detergent composition A may include anti-redeposition agents. Without wishing to be bound by any particular theory, it is thought that anti-redeposition agents aid in preventing loosened soil from redepositing onto cleaned fabrics. Anti-redeposition agents can be used to facilitate sustaining a suspension of soils in a use solution and reduce the tendency of the soils to be redeposited onto a substrate from which they have been removed.

Exemplary anti-redeposition agents include fatty acid amides, fluorocarbon surfactants, complex phosphate esters, styrene maleic anhydride copolymers, and cellulosic derivatives such as carboxymethyl cellulose, hydroxyethyl cellulose, hydroxypropyl cellulose, and the like. Specific exemplary anti-redeposition agents include styrene maleic anhydride copolymers, sodium tripolyphosphate, sodium carboxymethyl cellulose, polyvinyl-pyrrolidone, acrylic acid polymers, and maleic/olefinic copolymers. The amount of anti-redeposition agents can be about >=0.1 wt.-% to about <=10 wt.-%, preferably about >=0.2 wt.-% to about <=5 wt.-%, further preferred about >=0.3 wt.-% to about <=1 wt.-%, and more preferred about >=0.4 wt.-% to about <=0.5 wt.-%, based on the weight of the detergent composition A.

Optical Brightener

Optical brightener, referred to as fluorescent whitening agent or fluorescent brightening agent, provides optical compensation for the yellow cast in fabric substrates. With optical brighteners, yellowing is replaced by light emitted from optical brighteners present in the area commensurate in scope with yellow color. The violet to blue light supplied by the optical brighteners combines with other light reflected from the location to provide a substantially complete or enhanced bright white appearance. The brightener through fluorescence produces this additional light. Optical brighteners can absorb light in the ultraviolet range (e.g., 275-400 nm) and can emit light in the ultraviolet blue spectrum (e.g., 400-500 nm).

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule.

Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

The choice of optical brighteners for use in detergent composition A of the first components will depend upon a number of factors, such as the type of detergent, the nature of other components present in the detergent composition A of the first component, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent composition A of the first components should contain a mixture of brighteners, which are effective for a variety of fabrics. It is of course necessary that the individual components of such a brightener mixture be compatible.

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents.

Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal® 5 BM-GX, Tinopal® CBS-CL, Tinopal® CBS-X, Tinopal® DMS-X and Tinopal® AMS-GX, available from BASF.

Further examples of these types of brighteners are disclosed in 'The Production and Application of Fluorescent Brightening Agents', M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. Preferred optical brighteners include stilbene derivatives.

Optical brightners that can be suitable used are 4,4'-bis-(2-sulostyryl)biphenyl (CBS-X) and/or 4,4'-bis-[(4,6-di-anilino-s-triazin-2-yl)-amino]-2,2'-stilbenedisulfonate (DMS-X).

The amount of optical brighteners can be about >=0.1 wt.-% to about <=2 wt.-%, and more preferred about >=0.2 wt.-% to about <=1 wt.-%, based on the weight of detergent composition A.

Defoaming Agents

Generally, defoamers which can be used in accordance with the invention include silica and silicones; aliphatic acids or esters; alcohols; sulfates or sulfonates; amines or amides; halogenated compounds such as fluorochlorohydrocarbons; vegetable oils, waxes, mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof.

One of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Corning Corporation. These defoamers can be present at a concentration range from about 0.01 wt.-% to about 20 wt.-%, from about 0.01 wt.-% to about 5 wt.-%, from about 0.01 wt.-% to about 4 wt.-%, from about 0.01 wt.-% to about 3 wt.-%, from about 0.01 wt.-% to about 2 wt.-%, from about 0.01 wt.-% to about 1.5 wt.-%, or from about 0.01 wt.-% to about 1 wt.-%.

Other defoamers that can be used in preferred embodiments of the invention include organic amides such as Antimussol® from Clariant or oil and/or polyalkylene based compounds such as Agitan® from Münzing or branched fatty alcohols such as Isofol® from Sasol.

The compositions of the present invention may further include antifoaming agents or defoaming agents which are based on alcohol alkoxylates that are stable in alkaline environments and are oxidatively stable. To this end one of the more effective antifoaming agents are the alcohol alkoxylates having an alcohol chain length of about $C_8$-$C_{12}$, and more specifically $C_9$-$C_{11}$, and having poly-propylene oxide alkoxylate in whole or part of the alkylene oxide portion. Commercial defoamers commonly available of this type include alkoxylates such as the BASF Degressal's; especially Degressal SD20.

Furthermore so called cloud point defoamers (typically non-ionic surfactants consisting of ethoxylated/propoxylated alcohols) may be used in the present invention such as Plurafac® types from BASF or Dehypon® types from Cognis.

Chelant Component

The detergent composition A may comprise a chelant that exhibits soil removal properties when used at alkaline conditions. The chelant component is provided for tying up metals in the soil to assist in cleaning and detergency. The chelant component can be provided as part of the composition. The chelant component can be provided in the composition in an amount of about >=1 wt.-% to about <=30 wt.-%, preferably about >=2 wt.-% to about <=20 wt.-%, further preferred about >=4 wt.-% to about <=10 wt.-%, and more preferred about >=6 wt.-% to about <=8 wt.-%, based on the weight of the detergent composition A. It should be understood that the chelant component can include mixtures of different chelants.

Exemplary chelants that can be used according to the invention include phosphonates, sodium gluconate, pentasodium salt of diethylenetriamine pentaacetic acid (available under the name Versenex®80), sodium glucoheptonate, ethylene diamine tetraacetic acid (EDTA), salts of ethylene diamine tetraacetic acid, hydroxyethyl ethylene diamine triacetic acid (HEDTA), salts of hydroxyethyl ethylene diamine triacetic acid, nitrilotriacetic acid (NTA), salts of nitrilotriacetic acid, diethanolglycine sodium salt (DEG), ethanoldiglycine disodium salt (EDG), tetrasodium N,N-bis (carboxylatomethyl)-L-glutamate (GLDA), and mixtures thereof. Exemplary salts of ethylene diamine tetraacetic acid include disodium salts, tetrasodium salts, diammonium salts, and trisodium salts. An exemplary salt of hydroxyethyl ethylene diamine triacetic acid is the trisodium salt.

Suitable hydroxymonocarboxylic acid compounds include, but are not limited to, citric acid; propionic acid; gluconic acid; glycolic acid; glucoheptanoic acid; succinic acid; lactic acid; methyllactic acid; 2-hydroxybutanoic acid; mandelic acid; atrolactic acid; phenyllactic acid; glyeric acid; 2,3,4-trihydroxybutanoic acid; alpha hydroxylauric acid; benzillic acid; isocitric acid; citramalic acid; agaricic acid; quinic acid; uronic acids, including glucuronic acid, glucuronolactonic acid, galaturonic acid, and galacturonolactonic acid; hydroxypyruvic acid; ascorbic acid; and tropic acid. Preferred hydroxymonocarboxylic acid compounds include citric acid; propionic acid; gluconic acid; glycolic acid; glucoheptanoic acid; and succinic acid. Suitable hydroxydicarboxylic acid compounds include, but are not limited to, tartronic acid; malic acid; tartaric acid; arabiraric acid; ribaric acid; xylaric acid; lyxaric acid; glucaric acid; galactaric acid; mannaric acid; gularic acid; allaric acid; altraric acid; idaric acid; and talaric acid. Preferred hydroxydicarboxylic acid compounds include tartaric acid as well as ethylene diamine tetraacetic acid.

Suitable chelant that can be used in the first component are iminodisuccinate, preferably the sodium salt of iminodisuccinate, hydroxyethylidene diphosphonic acid and/or tetrasodium N,N-bis(carboxylatomethyl)-L-glutamate (GLDA).

Sequestrants/Builder

The detergent composition A may include a sequestrant. In general, a sequestrant is a molecule capable of coordinating (i.e., binding) the metal ions commonly found in natural water to prevent the metal ions from interfering with the action of the other detersive ingredients of a detergent composition. Some chelating/sequestering agents can also function as a threshold agent when included in an effective amount. For a further discussion of chelating agents/sequestrants, see Kirk-Othmer, Encyclopedia of Chemical Technology, Third Edition, volume 5, pages 339-366 and volume 23, pages 319-320. A variety of sequestrants can be used including, for example, organic phosphonate, aminocarboxylic acid, condensed phosphate, inorganic builder, polymeric polycarboxylate, mixture thereof, or the like. Such sequestrants and builders are commercially available.

Suitable condensed phosphates include sodium and potassium orthophosphate, sodium and potassium pyrophosphate, sodium and potassium tripolyphosphate, sodium hexametaphosphate, preferably of tripolyphosphate.

In an embodiment, the composition of the invention includes as sequestrant or builder condensed phosphate and polyacrylate, or another polymer, for example, sodium tripolyphosphate and polyacrylate.

Sodium salts of condensed phosphates are preferred to the corresponding potassium salts.

The builder can include an organic phosphonate, such as an organic-phosphonic acid and alkali metal salts thereof. Some examples of suitable organic phosphonates include:

1-hydroxyethane-1,1-diphosphonic acid:
$CH_3C(OH)[PO(OH)_2]_2$;
aminotri(methylenephosphonic acid):
$N[CH_2PO(OH)_2]_3$;
aminotri(methylenephosphonate), sodium salt;
2-hydroxyethyliminobis(methylenephosphonic acid):
$HOCH_2CH_2N[CH_2PO(OH)_2]_2$;
diethylenetriaminepenta(methylenephosphonic acid):
$(HO)_2POCH_2N[CH_2CH_2N[CH_2PO(OH)_2]_2]_2$;
diethylenetriaminepenta(methylene-phosphonate), sodium salt:
$C_9H_{(28-x)}N_3Na_xO_{15}P_5$ (x=7);
hexamethylenediamine(tetramethylenephosphonate), potassium salt:
$C_9H_{(28-x)}N_2K_xO_{12}P_4$ (x=6);
bis(hexamethylene)triamine(pentamethylenephosphonic acid):
$(HO_2)POCH_2N[CH_2)_6N[CH_2PO(OH)_2]_2]_2$; and phosphorus acid $H_3PO_3$; and other similar organic phosphonates, and mixtures thereof.

2-hydroxyethyliminobis(methylenephosphonic acid):
$HOCH_2CH_2N[CH_2PO(OH)_2]_2$;
diethylenetriaminepenta(methylenephosphonic acid):
$(HO)_2POCH_2N[CH_2CH_2N[CH_2PO(OH)_2]_2]_2$;
diethylenetriaminepenta(methylenephosphonate), sodium salt:
$C_9H_{(28-x)}N_3Na_xO_{15}P_5$ (x=7);
hexamethylenediamine(tetramethylenephosphonate), potassium salt:
$C_{10}H_{(28-x)}N_2K_xO_{12}P_4$ (x=6);
bis(hexamethylene)triamine(pentamethylenephosphonic acid):
$(HO_2)POCH_2N[CH_2)_6N[CH_2PO(OH)_2]2]_2$; and phosphorus acid $H_3PO_3$; and other similar organic phosphonates, and mixtures thereof.

The sequestrant can be or include aminocarboxylic acid type sequestrant. Suitable aminocarboxylic acid type sequestrants include the acids or alkali metal salts thereof, e.g., amino acetates and salts thereof. Some examples include N-hydroxyethylaminodiacetic acid; hydroxyethylenediaminetetraacetic acid, nitrilotriacetic acid (NTA); methylglycinediacetic acid (MGDA); 2-hydroxyethyliminodiacetic acid (HEIDA); ethylenediaminetetraacetic acid (EDTA); N-hydroxyethyl-ethylenediaminetriacetic acid (HEDTA); diethylenetriaminepentaacetic acid (DTPA); and alanine-N,N-diacetic acid; and the like; and mixtures thereof. Preferred amino carboxylates include the sodium salt of EDTA, MGDA, and HEIDA.

An exemplary sequestrant or builder that can be used includes iminodisuccinic acid (IDS) and salt of iminodisuccinic acid. Such sequestrants are desirable because they are generally considered to be more environmentally friendly compared with other sequestrants.

It should be understood that the sequestrant and/or builder are optional components.

When the composition of the invention includes a sequestrant and/or builder, the sequestrant and/or builder can be provided in an amount of about >=1 wt.-% to about <=30 wt.-%, preferably about >=2 wt.-% to about <=20 wt.-%, further preferred about >=4 wt.-% to about <=10 wt.-%, and more preferred about >=6 wt.-% to about <=8 wt.-%, based on the weight of the detergent composition A.

Enzymes

The detergent composition A may further comprise an enzyme material. The enzyme material can be selected from proteases, amylases, lipases, cellulases, peroxidases, and mixtures thereof. The enzyme material can be present in said composition in a concentration of from about 0.001 wt.-% to about 3 wt.-%, based on the weight of the detergent composition A.

The detergent composition A can comprise one or more enzymes which provide cleaning performance and/or fabric care benefits. Enzymes can be included herein for a wide variety of fabric laundering purposes, including removal of protein-based, carbohydrate-based, or triglyceride-based stains, for example, and/or for fabric restoration. Examples of suitable enzymes include, but are not limited to, hemicellulases, peroxidases, proteases, cellulases, xylanases, lipases, phospholipases, esterases, cutinases, pectinases, keratinases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases, or combinations thereof and may be of any suitable origin. The choice of enzyme(s) takes into account factors such as pH-activity, stability optima, thermostability, stability versus active detergents, chelants, builders, etc. A detersive enzyme mixture useful herein is a protease, lipase, cutinase and/or cellulase in conjunction with amylase. Sample detersive enzymes are described in U.S. Pat. No. 6,579,839.

Enzymes are normally present at up to about 5 mg, more typically from about 0.01 mg to about 3 mg by weight of active enzyme per gram of the detergent. Stated another way, the detergent herein will typically contain from about 0.001 to about 5%, or from about 0.01% to about 2%, or from about 0.05% to about 1% by weight of a commercial enzyme preparation. Protease enzymes are present at from about 0.005 to about 0.1 AU of activity per gram of detergent. Proteases useful herein include those like subtilisins from *Bacillus* [e.g. *Bacillus subtilis, Bacillus lentus, Bacillus licheniformis, Bacillus amyloliquefaciens* (BPN, BPN'), *Bacillus alcalophilus*] e.g. Esperase®, Alcalase®, Everlase® and Savinase® (Novozymes), BLAP and variants (Henkel). Further proteases are described in EP 130756, WO 91/06637, WO 95/10591 and WO 99/20726. Amylases are described in GB Pat. #1 296 839, WO 94/02597 and WO 96/23873; and available as Purafect Ox Am® (Genencor), Termamyl®, Natalase®, Ban®, Fungamyl®, Duramyl® (all Novozymes), and RAPID ASE (International Bio-Synthetics, Inc).

The cellulase herein includes bacterial and/or fungal cellulases with a pH optimum between 5 and 9.5. Suitable cellulases are disclosed in U.S. Pat. No. 4,435,307 to Barbesgoard, et al., issued Mar. 6, 1984. Cellulases useful herein include bacterial or fungal cellulases, e.g. produced by *Humicola insolens*, particularly DSM 1800, e.g. 50 kD and ~43 kD (Carezyme®). Additional suitable cellulases are the EGIII cellulases from *Trichoderma longibrachiatum*. WO 02/099091 by Novozymes describes an enzyme exhibiting endo-beta-glucanase activity (EC 3.2.1.4) endogenous to *Bacillus* sp., DSM 12648; for use in detergent and textile applications; and an anti-redeposition endo-glucanase in WO 04/053039. Kao's EP 265 832 describes alkaline cellulase K, CMCase I and CMCase II isolated from a culture product of *Bacillus* sp. KSM-635. Kao further describes in EP 1 350 843 (KSM S237; 1139; KSM 64; KSM N131), EP 265 832A (KSM 635, FERM BP 1485) and EP 0 271 044 A (KSM 534, FERM BP 1508; KSM 539, FERM BP 1509; KSM 577, FERM BP 1510; KSM 521, FERM BP 1507; KSM 580, FERM BP 1511; KSM 588, FERM BP 1513; KSM 597, FERM BP 1514; KSM 522, FERM BP 1512; KSM 3445, FERM BP 1506; KSM 425. FERM BP 1505) readily-mass producible and high activity alkaline cellulases/endo-glucanases for an alkaline environment. Such endo-glucanase may contain a polypeptide (or variant thereof) endogenous to one of the above *Bacillus* species. Other suitable cellulases are Family 44 Glycosyl Hydrolase enzymes exhibiting endo-beta-1,4-glucanase activity from *Paenibacilus polyxyma* (wild-type) such as XYG1006 described in WO 01/062903 or variants thereof. Carbohydrases useful herein include e.g. mannanase (see, e.g., U.S. Pat. No. 6,060,299), pectate lyase (see, e.g., WO99/27083), cyclomaltodextrin glucanotransferase (see, e.g., WO96/33267), and/or xyloglucanase (see, e.g., WO99/02663). Bleaching enzymes useful herein with enhancers include e.g. peroxidases, laccases, oxygenases, lipoxygenase (see, e.g., WO 95/26393), and/or (non-heme) haloperoxidases.

Suitable endoglucanases include:

1) An enzyme exhibiting endo-beta-1,4-glucanase activity (E.C. 3.2.1.4), with a sequence at least 90%, or at least 94%, or at least 97% or at least 99%, or 100% identity to the amino acid sequence of positions 1-773 of SEQ ID NO:2 in WO 02/099091; or a fragment thereof that has endo-beta-1,4-glucanase activity. GAP in the GCG program determines identity using a GAP creation penalty of 3.0 and GAP extension penalty of 0.1. See WO 02/099091 by Novozymes A/S on Dec. 12, 2002, e.g., Celluclean™ by Novozymes A/S. GCG refers to sequence analysis software package (Accelrys, San Diego, Calif., USA). GCG includes a program called GAP which uses the Needleman and Wunsch algorithm to find the alignment of two complete sequences that maximizes the number of matches and minimizes the number of gaps; and 2) Alkaline endoglucanase enzymes described in EP 1 350 843A published by Kao on Oct. 8, 2003 ([0011H0039] and examples 1-4). Suitable lipases include those produced by *Pseudomonas* and *Chromobacter*, and LIPOLASE®, LIPOLASE ULTRA®, LIPOPRIME® and LIPEX® from Novozymes. See also Japanese Patent Application 53-20487, laid open on Feb. 24, 1978, available from Areario Pharmaceutical Co. Ltd., Nagoya, Japan, under the trade name Lipase P "Amano". Other commercial lipases include Amano-CES, lipases ex *Chromobacter viscosum*, available from Toyo Jozo Co., Tagata, Japan; and *Chromobacter viscosum* lipases from U.S. Biochemical Corp., U.S.A. and Diosynth Co., The Netherlands, and lipases ex *Pseudomonas gladioli*. Also suitable are cutinases [EC 3.1.1.50] and esterases. Enzymes useful for liquid detergent formulations, and their incorporation into such formulations, are disclosed in U.S. Pat. No. 4,261,868 to Hora, et al., issued Apr. 14, 1981. In an embodiment, the liquid composition herein is substantially free of (i.e. contains no measurable amount of) wild-type protease enzymes. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the composition.

Enzyme Stabilizers

Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability. A useful enzyme stabilizer system is a calcium and/or magnesium compound, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth) acrylic acid-(meth)acrylic acid ester copolymer and PEG; lignin compound, polyamide oligomer, glycolic acid or its salts; poly hexa methylene bi guanide or N,N-bis-3-aminopropyl-dodecyl amine or salt; and mixtures thereof. The detergent may contain a reversible protease inhibitor e.g., peptide or protein type, or a modified subtilisin inhibitor of family VI and the plasminostrepin; leupeptin, peptide trifluoromethyl ketone, or a peptide aldehyde. Enzyme stabilizers are present from about 1 to about 30, or from about 2 to about 20, or from about 5 to about 15, or from about 8 to about 12, millimoles of stabilizer ions per liter.

Preserving Agent

As mentioned before, in step b) of the method according to the present invention in addition to the detergent composition A, preferably a preserving agent is also used in the wash liquid. Preserving agents are used for reduction or prevention of growth of microorganisms in the detergent composition A. Preserving agents are also used in the wash liquid in order to reduce or prevent growth of microorganisms in the use solution of detergent composition A and on the cleaning textiles.

Preferably the preserving agent is chosen from amines, quaternary ammonium compounds, aldehydes, antimicrobial acids and salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolines and mixtures thereof.

These preserving agents act effectively against viruses, bacteria, moulds or yeasts.

Preserving agents in the context of this application refer to those compounds possessing an antimicrobial action and able to reduce the number of microorganisms on textile fabrics treated therewith and in the use solution of the detergent composition A in which the cleaning textiles are washed.

Depending on the antimicrobial spectrum and mechanism of action, preserving agents or biocidal compounds are differentiated into bacteriostats and bactericides, fungistats and fungicides, etc. Suitable preserving agents are preferably chosen from amines, quaternary ammonium compounds, aldehydes, antimicrobial acids or salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolines, 1,2-dibromo-2,4-dicyanobutane, iodo-2-propylbutyl carbamate, iodine, iodophores, halogen compounds and any mixtures of the above.

Preserving agents here include undecylenic acid, salicylic acid, dihydroacetic acid, o-phenylphenol, N-methylmorpholinoacetonitrile (MMA), 2-benzyl-4-chlorophenol, 2,2'-methylenebis(6-bromo-4-chlorophenol), 4,4'-dichloro-2'-hydroxydiphenyl ether (diclosan), 2,4,4'-trichloro-2'-hydroxydiphenyl ether (triclosan), chlorhexidine, N-(4-chlorophenyl)-N-(3,4-dichlorophenyl)urea, N,N'-(1,10-decanediyldi-1-pyridinyl-4-ylidene)-bis(1-octanamine) dihydrochloride, N,N'-bis(4-chlorophenyl)-3,12-diimino-2,4,11,13-tetraazatetradecanediimidamide, glucoprotamines, guanidines including the bi- and polyguanidines, such as e.g. 1,6-bis(2-ethylhexylbiguanidohexane)dihydrochloride, 1,6-di-(N1,N1'-phenyldiguanido-N5,N5')hexane tetrahydrochloride, 1,6-di-(N1,N1'-phenyl-N1,N1-methyldiguanido-N5,N5')hexane di hydrochloride, 1,6-di-(N1,N1'-o-chlorophenyldiguanido-N5,N5')hexane di hydrochloride, 1,6-di(N1,N1'-2,6-dichlorophenyldiguanido-N5,N5')hexane dihydrochloride, 1,6-di-[N1,N1'-beta-(p-methoxyphenyl) diguanido-N5,N5']hexane dihydrochloride, 1,6-di-(N1,N1'-alpha-methyl-beta.-phenyldiguanido-N5,N5')hexane dihydrochloride, 1,6-di-(N1,N1'-p-nitrophenyldiguanido-N5,N5')hexane dihydrochloride, omega:omega-di-(N1,N1'-phenyldiguanido-N5,N5')-di-n-propyl ether dihydrochloride, omega:omega'-di-(N1,N1'-p-chlorophenyldiguanido-N5,N5')-di-n-propyl ether tetrahydrochloride, 1,6-di-(N1,N1'-2,4-dichlorophenyldiguanido-N5,N5') hexane tetrahydrochloride, 1,6-di-(N1,N1'-p-methylphenyldiguanido-N5,N5')hexane dihydrochloride, 1,6-di-(N1,N1'-2,4,5-trichlorophenyldiguanido-N5,N5')hexane tetrahydrochloride, 1,6-di-[N1,N1'-alpha-(p-chlorophenyl) ethyldiguanido-N5,N5']hexane dihydrochloride, omega:omega-di-(N1,N1'-p-chlorophenyldiguanido-N5,N5')m-xylyl dihydrochloride, 1,12-di-(N1,N1'-p-chlorophenyldiguanido-N5,N5')dodecane dihydrochloride, 1,10-di-(N1,N1'-phenyldiguanido-N5,N5')decane tetrahydrochloride, 1,12-di-(N1,N1'-phenyldiguanido-N5,N5')dodecane tetrahydrochloride, 1,6-di-(N1,N1'-o-chlorophenyldiguanido-N5,N5')hexane dihydrochloride, 1,6-di-(N1,N1'-o-chlorophenyldiguanido-N5,N5')hexane tetrahydrochloride, ethylenebis(1-tolylbiguanide), ethylenebis(p-tolylbiguanide), ethylenebis(3,5-dimethylphenylbiguanide), ethylenebis(p-tert-amylphenylbiguanide), ethylenebis(nonylphenylbiguanide), ethylenebis (phenylbiguanide), ethylenebis(N-butylphenylbiguanide), ethylenebis(2,5-diethoxyphenylbiguanide), ethylenebis(2,4-dimethylphenylbiguanide), ethylenebis(o-diphenylbiguanide), N-butyl ethylene-bis(phenylbiguanide), trimethylenebis(o-tolylbiguanide), N-butyl tri methylene-bis (phenylbiguanide) and the corresponding salts such as acetates, gluconates, hydrochlorides, hydrobromides, citrates, bisulfites, fluorides, polymaleates, N-cocoalkyl sarcosinates, phosphites, hypophosphites, perfluorooctanoates, silicates, sorbates, salicylates, maleates, tartrates, fumarates, ethylenediamine tetraacetates, imino diacetates, cinnamates, thiocyanates, arginates, pyromellitates, tetracarboxybutyrates, benzoates, glutarates, monofluorophosphates and perfluoropropionates as well as any mixtures thereof.

Also suitable are halogenated xylene and cresol derivatives, such as p-chlorometacresol or p-chlorometaxylene.

Preferably, the preserving agent is a quaternary ammonium compound. Quaternary ammonium compounds (QACs) suitable as active preserving agents have the general formula $$(R^1)(R^2)(R^3(R^4)N^+X^-$$

wherein $R^1$ to $R^4$ are the same or different C1-C22 alkyl residues, C7-C28 aralkyl residues or heterocyclic residues, wherein two or, in the case of aromatic bonding as in pyridine, even three residues form the heterocycle (e.g., a pyridinium or imidazolinium compound) together with the nitrogen atom, and $X^-$ are halide ions, sulfate ions, hydroxide ions or similar anions.

QACs can be produced by reacting tertiary amines with alkylating agents such as methyl chloride, benzyl chloride, dimethyl sulfate, dodecyl bromide and ethylene oxide. Alkylation of tertiary amines with a long alkyl residue and two methyl groups is achieved particularly readily, and even quaternization of tertiary amines with two long residues and a methyl group can be carried out under mild conditions with the aid of methyl chloride. Amines having three long alkyl residues or hydroxy-substituted alkyl residues are of low reactivity and are preferably quaternized with dimethyl sulfate.

Suitable QACs include benzalkonium chloride (N-alkyl-N,N-dimethylbenzylammonium chloride, CAS No. 8001-54-5), benzalkon B (m,p-dichlorobenzyldimethyl-C12-alkylammonium chloride, CAS No. 58390-78-6), benzoxonium chloride (benzyklodecylbis(2-hydroxyethyl)ammonium chloride), cetrimonium bromide (N-hexadecyl-N,N,N-trimethylammonium bromide, CAS No. 57-09-0), benzethonium chloride (N,N-dimethyl-N-[2-[2-[p-(1,1,3,3-tetramethylbutyl)phenoxy]ethoxy]ethyl]benzylammonium chloride, CAS No. 121-54-0), dialkyldimethylammonium chlorides such as di-n-decyldimethyl-ammonium chloride (CAS No. 7173-51-5-5), didecyldimethylammonium bromide (CAS No. 2390-68-3), dioctyldimethylammonium chloride, 1-cetylpyridinium chloride (CAS No. 123-03-5) and thiazoline iodide (CAS No. 15764-48-1) and mixtures thereof. Particularly preferred QACs are dialkyldimethylammonium chlorides, in particular di-n-decyldimethylammonium chloride, N-octadecyl-N,N,N-trimethylammonium chloride, N-hexadecyl-N,N,N-trimethylammonium chloride and the benzalkonium chlorides with C8-C18 alkyl residues, in particular C12-C14 alkylbenzyldimethylammonium chloride. Another preferred preserving agent is methyl-N-(2-hydroxyethyl)-N,N-di(caproyloxyethyl)ammonium methosulfate. Apart from the fact that these preserving agents act effectively against numerous microorganisms, the cationic compounds absorb particularly well on to cotton-containing fabrics and mixed fabrics.

Dialkyldimethylammonium halides, benzalkonium halides and/or substituted benzalkonium halides are commercially available, for example, as Barquat® from Lonza, Marquat® from Mason, Variquat® from Evonik Industries and Hyamine® from Lonza. Another preferred preserving agent is 2-bromo-2-nitropropane-1,3-diol (CAS 52-51-7; Bronopol®). A still further preferred preserving agent is selected from isothiazolinone biocides, in particular 5-chloro-2-methyl-4-isothiazolin-3-one (chloromethylisothiazolinone: CMIT) and 2-methyl-4-isothiazolin-3-one (methylisothiazolinone: MIT).

Product to be used for the washing liquid is up to 50% active. The dosage concentration varies dependent from the chemical molecule.

In another preferred embodiment the preserving agent is represented by a bleaching composition.

In a preferred embodiment the bleaching composition comprises a peracid selected from:

a) peracids corresponding to general formula (IV) $R^4—O_2C—(CH_2)_q—CO_3H$, wherein $R^4$ is hydrogen or an alkyl group containing 1 to 4 carbon atoms and q is an integer from 1 to 4, or salts thereof;

b) phthalimidopercarboxylic acids (V) wherein the percarboxylic acid contains 1 to 18 carbon atoms, or salts thereof;

c) compounds corresponding to formula (VI) $R^5—CO_3H$, wherein $R^5$ is an alkyl or alkenyl group containing 1 to 18 carbon atoms.

In a further preferred embodiment the bleaching composition comprises a peracid selected from:

a) peracids corresponding to general formula (IV) $R^4—O_2C—(CH_2)_q—CO_3H$, wherein $R^4$ is hydrogen or methyl group and q is an integer from 1 to 4, or salts thereof;

b) phthalimidopercarboxylic acids (V) wherein the percarboxylic acid contains 1 to 8 carbon atoms, or salts thereof;

c) compounds corresponding to formula (VI) $R^5—CO_3H$, wherein $R^5$ is an alkyl or alkenyl group containing 1 to 12 carbon atoms.

Further preferred the peracid is selected from peracetic acid, perpropionic acid, peroctanoic acid, phthalimidoperhexanoic acid, phthalimidoperoctanoic acid, persuccinic acid, persuccinic acid monomethyl ester, perglutaric acid, perglutaric acid monomethyl ester, peradipic acid, peradipic acid monomethyl ester, persuccinic acid, and persuccinic acid monomethyl ester.

In a still further preferred embodiment the bleaching composition comprises 1 to 30 wt.-% of peracid.

In another preferred embodiment the bleaching composition additionally contains 0.01 to 35 wt.-% of hydrogen peroxide.

In a particularly preferred embodiment the bleaching composition comprises at least a mixture of hydrogen peroxide, peracid and the corresponding acid. It is most preferred that the bleaching composition comprises at least hydrogen peroxide, peroxyacetic acid and acetic acid.

Bleaching Composition

Detergent concentrate compositions, in particular liquid detergent concentrate compositions as such preferably do not contain any bleaching agents. In institutional and industrial washing processes the bleaching agent is normally dosed separately from the detergent. Only in powder household detergents bleaching agents are present.

According to the present invention the washing step b) of washing soiled cleaning textiles is carried out with detergent composition A also used for surface cleaning, in particular floor cleaning. The detergent composition A itself preferably does not comprise a bleaching composition. According to the present invention cleaning textiles are permanently wet or at least moist, because they are either being used in surface cleaning, in particular floor cleaning, they are being washed or being stored in wet or moist condition after washing and ready for use for surface cleaning, in particular floor cleaning. In order to avoid molding preferably a preserving agent is added to the cleaning textiles and/or the washing liquid. Preferably the preserving agent is a bleaching agent.

In some aspects, the bleaching compositions include at least one oxidizing agent. The bleaching composition can include any of a variety of oxidizing agents, for example, hydrogen peroxide and/or any inorganic or organic peroxide or peracid. The oxidizing agent can be present at an amount effective to convert a carboxylic acid to a peroxycarboxylic acid. In some embodiments, the oxidizing agent can also have antimicrobial activity. In other embodiments, the oxidizing agent is present in an amount insufficient to exhibit antimicrobial activity.

In some embodiments, the bleaching compositions include about 0.001 wt.-% oxidizing agent to 60 wt.-% oxidizing agent. In other embodiments, the bleaching compositions include about 10 wt.-% to about 30 wt.-% oxidizing agent.

Examples of inorganic oxidizing agents include the following types of compounds or sources of these compounds, or alkali metal salts including these types of compounds, or forming an adduct therewith: hydrogen peroxide, urea-hydrogen peroxide complexes or hydrogen peroxide donors of: group 1 (IA) oxidizing agents, for example lithium peroxide, sodium peroxide; group 2 (IIA) oxidizing agents, for example magnesium peroxide, calcium peroxide, strontium peroxide, barium peroxide; group 12 (IIB) oxidizing agents, for example zinc peroxide; group 13 (IIIA) oxidizing agents, for example boron compounds, such as perborates, for example sodium perborate hexahydrate of the formula $Na_2[B_2(O_2)_2(OH)_4].6H_2O$ (also called sodium perborate tetrahydrate); sodium peroxyborate tetrahydrate of the formula $Na_2B_2(O_2)_2[(OH)_4].4H_2O$ (also called sodium perborate trihydrate); sodium peroxyborate of the formula $Na_2[B_2(O_2)_2(OH)_4]$ (also called sodium perborate monohydrate); group 14 (IVA) oxidizing agents, for example persilicates and peroxycarbonates, which are also called percarbonates, such as persilicates or peroxycarbonates of alkali metals; group 15 (VA) oxidizing agents, for example peroxynitrous acid and its salts; peroxyphosphoric acids and their salts, for example, perphosphates; group 16 (VIA) oxidizing agents, for example peroxysulfuric acids and their salts, such as peroxymonosulfuric and peroxydisulfuric acids, and their salts, such as persulfates, for example, sodium persulfate; and group Vila oxidizing agents such as sodium periodate, potassium perchlorate. Other active inorganic oxygen compounds can include transition metal peroxides; and other such peroxygen compounds, and mixtures thereof.

Examples of organic oxidizing agents include, but are not limited to, perbenzoic acid, derivatives of perbenzoic acid, t-butyl benzoyl hydroperoxide, benzoyl hydroperoxide, or any other organic based peroxide and mixtures thereof, as well as sources of these compounds. Other examples include, but are not limited to, peracids including $C_1$-$C_{22}$ percarboxylic acids such as peracetic acid, performic acid, percarbonic acid, peroctanoic acid, and the like; per-diacids or per-triacids such as peroxalic acid, persuccinic acid, percitric acid, perglycolic acid, permalic acid and the like; and aromatic peracids such as perbenzoic acid, or mixtures thereof.

The method of the present invention may employ one or more of the inorganic oxidizing agents listed above. Suitable inorganic oxidizing agents include ozone, hydrogen peroxide, hydrogen peroxide adduct, group IIIA oxidizing agent, or hydrogen peroxide donors of group VIA oxidizing agent, group VA oxidizing agent, group VIIA oxidizing agent, or mixtures thereof. Suitable examples of such inorganic oxidizing agents include percarbonate, perborate, persulfate, perphosphate, persilicate, or mixtures thereof.

Carboxylic and Percarboxylic Acids

The bleaching compositions used in the method of the present invention may include at least one carboxylic and/or percarboxylic acid. In some embodiments, bleaching compositions include at least two or more carboxylic and/or percarboxylic acids.

In a preferred embodiments, the carboxylic acid for use in the method of the present invention includes a $C_1$ to $C_{22}$ carboxylic acid. Further preferred the carboxylic acid for use in the method of the present invention is a $C_1$ to $C_{12}$ carboxylic acid. The carboxylic acid for use in the method of the present invention in particular may be a $C_5$ to $C_{12}$ carboxylic acid. In particular preferred embodiments, the carboxylic acid for use in the method of the present invention is a $C_1$ to $C_4$ carboxylic acid. Examples of suitable carboxylic acids include, but are not limited to, formic, acetic, propionic, butanoic, pentanoic, hexanoic, heptanoic, octanoic, nonanoic, decanoic, undecanoic, dodecanoic, as well as their branched isomers, lactic, maleic, ascorbic, citric, hydroxyacetic, neopentanoic, neoheptanoic, neodecanoic, oxalic, malonic, succinic, glutaric, adipic, pimelic subric acid, and mixtures thereof.

The bleaching compositions used in the method of the present invention preferably include about 0.1 wt.-% to about 80 wt.-% of a carboxylic acid. In other embodiments, the compositions include about 1 wt.-% to about 60 wt.-% of a carboxylic acid. In yet other embodiments, the compositions include about 20 wt.-%, about 30 wt.-%, or about 40 wt.-% of a carboxylic acid. In further preferred embodiments, the compositions include about 5 wt.-% to about 10 wt.-% of acetic acid. In other embodiments, the compositions include about 5 wt.-% to about 10 wt.-% of octanoic acid. Further preferred, the bleaching compositions used in the method of the present invention include a combination of octanoic acid and acetic acid.

The bleaching compositions used in the method of the present invention preferably include at least one peroxycarboxylic acid. Peroxycarboxylic acids useful in the bleaching compositions include peroxyformic, peroxyacetic, peroxypropionic, peroxybutanoic, peroxypentanoic, peroxyhexanoic, peroxyheptanoic, peroxyoctanoic, peroxynonanoic, peroxydecanoic, peroxyundecanoic, peroxydodecanoic, or the peroxyacids of their branched chain isomers, peroxylactic, peroxymaleic, peroxyascorbic, peroxyhydroxyacetic, peroxyoxalic, peroxymalonic, peroxysuccinic, peroxyglutaric, peroxyadipic, peroxypimelic and peroxysubric acid and mixtures thereof. The bleaching compositions may utilize a combination of several different peroxycarboxylic acids. For example, in some embodiments, the composition includes one or more $C_1$ to $C_4$ peroxycarboxylic acids and one or more $C_5$ to $C_{12}$ peroxycarboxylic acids. In some embodiments, the $C_1$ to $C_4$ peroxycarboxylic acid is peroxyacetic acid and the $C_5$ to $C_{15}$ acid is peroxyoctanoic acid.

In further preferred embodiments of the method, the bleaching compositions include peroxyacetic acid. Peroxyacetic (or peracetic) acid is a peroxycarboxylic acid having the formula: $CH_3COOOH$. Generally, peroxyacetic acid is a liquid having an acrid odor at higher concentrations and is freely soluble in water, alcohol, ether, and sulfuric acid. Peroxyacetic acid can be prepared through any number of methods known to those of skill in the art including preparation from acetaldehyde and oxygen in the presence of cobalt acetate. A solution of peroxyacetic acid can be obtained by combining acetic acid with hydrogen peroxide. A 50% solution of peroxyacetic acid can be obtained by combining acetic anhydride, hydrogen peroxide and sulfuric acid.

In preferred embodiments, the bleaching compositions used in the method of the present invention include peroxyoctanoic acid, peroxynonanoic acid, or peroxyheptanoic acid. In further preferred embodiments, the bleaching compositions include peroxyoctanoic acid. Peroxyoctanoic (or peroctanoic) acid is a peroxycarboxylic acid having the formula, for example, of n-peroxyoctanoic acid: $CH_3(CH_2)_6COOOH$. Peroxyoctanoic acid can be an acid with a straight chain alkyl moiety, an acid with a branched alkyl moiety, or a mixture thereof. Peroxyoctanoic acid can be prepared through any number of methods known to those of skill in the art. A solution of peroxyoctanoic acid can be obtained by combining octanoic acid and hydrogen peroxide and a hydrotrope, solvent or carrier.

Further preferred, the bleaching compositions include about 0.1 wt.-% to about 90 wt.-% of one or more peroxycarboxylic acids. In other embodiments, the bleaching compositions include about 1 wt.-% to about 25 wt.-% of one or more peroxycarboxylic acids. In yet other embodiments, the bleaching compositions include about 5 wt.-% to about 10 wt.-% of one or more peroxycarboxylic acids. In some embodiments, the bleaching compositions include about 1 wt.-% to about 25 wt.-% of peroxyacetic acid. In other embodiments, the bleaching compositions include about 0.1 wt.-% to about 10 wt.-% of peroxyoctanoic acid. In still yet other embodiments, the bleaching compositions include a mixture of about 5 wt.-% peroxyacetic acid, and about 1.5 wt.-% peroxyoctanoic acid.

Further preferred, the peracid is selected from peracetic acid, perpropionic acid, peroctanoic acid, phthalimidoperhexanoic acid, phthalimidoperoctanoic acid, persuccinic acid, persuccinic acid monomethyl ester, perglutaric acid, perglutaric acid monomethyl ester, peradipic acid, peradipic acid monomethyl ester, persuccinic acid, and persuccinic acid monomethyl ester.

In a further preferred embodiment the bleaching compositions comprise 1 to 30 wt.-% of peracid. Further preferred, the bleaching compositions additionally contains 0.01 to 35 wt.-% of hydrogen peroxide. Still further preferred, the bleaching compositions comprises at least a mixture of hydrogen peroxide, peracid and the corresponding acid. Most preferred, the bleaching composition comprises at least hydrogen peroxide, peroxyacetic acid and acetic acid.

In a further preferred method the bleaching composition is used in a concentration of from 0.01 to 5, preferably from 0.1 to 2, further preferred from 0.1 to 1 wt.-% of the afore described concentrates in the washing liquid for washing the cleaning textiles according to step b) of the present invention.

The invention will be further described in the following examples which are only meant to exemplify the present invention without restricting its scope.

EXAMPLES

Example 1: Cleaning Ability Using Wet Abrasion Scrub Tester (Gardner)

The standard wet abrasion scrub tester according to Gardner is carried out as follows: the cleaning solution to be tested is poured on an artificially soiled white PVC test strip. A sponge is moved 10 times forwards and backwards. Afterwards, the test strip's whiteness is analyzed by a chromatometer.

Equipment

For this test the following equipment was used:

1. Gardner wet abrasion scrub tester apparatus model 494 (DIN-ASTM-515); Supplier: Erichsen GmbH & Co. KG
2. Minolta Chroma Meter CR-200; supplier: Minolta
3. Sponge press
4. White PVC-film Benova 4812080, 1,3 m/50 m/0.12 mm; Supplier: Benecke-Kaliko AG
5. Hard paperboard strips as substrate (dimensions: 40×554×1 mm); Supplier: Kappa Verpackungswerk Neuss
6. Pressure-sensitive adhesive J 6251 from Henkel (diluted 1:1 with ethyl acetate)
7. Template made of hard PVC
8. Polyester sponges
9. Flat paint brush with flat bristles, about 55 mm wide, used to apply test soil
10. Watch glass, for measuring the test soil
11. Standard test soil IPP 83/21, Supplier: wfk Krefeld
12. Carpet knife
13. Laboratory scale, range: 2000 g, measuring accuracy 0.01 g Preparation of Test Strips:

1. Use the template made of hard PVC to cut the white PVC-film.
2. Glue 7 paperboard stripes in a line closely next to each other on the rough (I) side of the PVC-film, so a resultant area of 280×554 cm is achieved. There should be no blisters or folders between the paperboard strips and the PVC-foil.
3. Let strips dry overnight.

Applying the Test Soil:

1. Place the PVC template on top of the PVC foil which is glued on the paperboard strips.
2. Weigh 2 g of test soil on a watch glass.
3. Apply the test soil with the flat brush on the white PVC foil within the template. Take in turns horizontal and vertical strokes. Repeat this 7 times in each direction. The last coat must be at right angles to the scouring movement.
4. Allow the soil to dry for one hour.

Determination of Cleaning Performance (RV-Value):

Soak the required amount of polyester sponges in tap water overnight. One sponge per strip is needed.

1. Cut the PVC film together with the paperboard strips along the brink (soil on top) with a carpet knife.
2. Place one strip on the guide rail on top of the Wet Abrasion Scrub Tester (Gardner).
3. Take one sponge out of the bucket and allow water to drip off.
4. Compress the sponge for 10 seconds in the sponge press.
   Place the sponge in the holder of the Gardner apparatus.
   Important: The sponge should lie on the surface with a weight of 400 g.
5. With a measuring spoon, pour cleaning product on top of the soiled strip and the sponge. For both the concentrated and the diluted product use a total volume of 25 ml.
6. Move the guide rails under the sponge holder and place the sponge on top of the soiled strip.
7. Set the cycle counter on 10 and switch on Gardner apparatus.
8. After the wipe cycle has been completed, take out the sponge and throw away (do not re-use).
9. Take off the test strip and rinse under running deionized water. Let water run through out the whole test to make sure the same water pressure is hitting the test strips.
10. Hang test strips up for drying.
11. Clean 6 soiled test strip per test solution.
12. For comparison clean 6 strips with tab water only.

Measuring the Degree of Whiteness (% RV):

1. Calibrate the instrument with the provided white tile.
2. Measure the reflection of all 6 strips at 7 different spots per strip. The average of the result gives the percentage of the cleanability.
3. Single large deviating results are rejected from the calculation.

Evaluation of the Results:

For the test product and a possible comparative dilution, the average is calculated for all measurements:

$$\bar{x} = \frac{1}{N}\sum_{i=1}^{N} x_i$$

N=number of measurements (6×7=42)

x=degree of whiteness per measure spot $X_{arithm}$=average cleaning performance Standard Deviation:

$$s_X^2 := \frac{1}{N-1}\sum_{i=1}^{N}(x_i - \bar{x})^2$$

Control:

The measurements are influenced by the quality of water and the environmental conditions in the lab, like temperature and humidity. Therefore, only the results achieved at one and the same day are comparable.

In the wet abrasion scrub test (Gardner) composition 1, composition 2 and a mixture thereof was tested. The ingredients of compositions 1 and 2 which are described in table 1. Composition 2 represents a bleaching agent which is suitable for preservation. In the test a product concentration of 1.0 wt.-% of composition 1, 0.25 wt.-% of composition 2 and a mixture 1 wt.-% of composition 1 and 0.25 wt.-% of composition 2 were tested in water in order to examine the respective cleaning performance. Water was used as control. Instead of 6 strips as described above 5 strips were used and therefore the reflection of 5 strips at 7 different spots per strip was measured. The results are summarized in table 2.

TABLE 1

| Ingredients of composition 1 and composition 2 | | |
|---|---|---|
| | raw materials | [wt.-%] |
| composition 1 | sodium diisooctylsulfosuccinate solution | 4.5 |
| | fatty alcohol alcoxylate C8-14, 7-10 EO, 7-10 BuO | 5.0 |
| | alcoholethoxylate, C4-8, 4-8 EO | 3.0 |
| | distilled coconut fatty acids | 0.3 |
| | solvents | 2.0 |
| | alkalines | 0.7 |
| | complexing agent | 2.0 |
| | silicone-base defoamer | 0.1 |
| | dyes | 0.00035 |
| | fragrance | 0.48 |
| | water | ad 100 |
| composition 2 | acetic acid in combination with peracetic acid | 5.60 |
| | diphosphonic acid | 0.50 |
| | hydrogen peroxide | 53.0 |
| | water | ad 100 |

TABLE 2

| cleaning performance (Gardner) | | | | |
|---|---|---|---|---|
| statistics [%] | water | composition 1 1 wt.-% | mixture: composition 1: 1 wt.-%, composition 2: 0.25 wt.-% | composition 2: 0.25 wt.-% |
| 1. Quartile | 56.70 | 77.01 | 76.13 | 59.89 |
| Min. | 53.60 | 74.34 | 75.50 | 52.91 |
| Median | 61.11 | 78.23 | 78.16 | 61.48 |
| Mean | 60.60 | 78.46 | 78.05 | 60.86 |
| Max. | 67.90 | 82.11 | 80.93 | 64.58 |
| 3. Quartile | 63.70 | 80.65 | 79.46 | 62.89 |

The mean cleaning performance was measured in percent. The results in table 2 show that composition 1 has a very high cleaning performance compared to water. Composition 2 is a bleaching agent which can be used as preserving agent. The results also show that composition 2 alone does not have a cleaning property and has no negative effect on the cleaning performance of composition 1.

Example 2: Primary Washing Performance in Mechanic Washing

Method:

This test method was used for the evaluation of the primary washing performance in one single application.

Equipment 1. washing machine (e.g. Miele WS 5071 Mop-Profi or Mini Washing Machine MWA 3101 from Clatronic)
2. spring scale
3. spectrophotometer CM-2619 d/Minolta Material and Chemicals 1. mechanically artificial soilings (Wfk-ECO-Monitors): (PES=polyester; CO=cotton)

| fat pigment soilings | |
|---|---|
| 20C | pigment/lanolin on PES/CO |
| 20D | pigment/sebum on PES/CO |
| EMPA 104 | soot/olive oil on PES/CO |

-continued

| | |
|---|---|
| 10 RM | soot/mineral oil on CO |
| 20 GM | used motor oil on PES/CO |
| 20 MU | make-up on PES/CO |
| EMPA 142/2 | lipstick on PES/CO |
| bleachable stains | |
| 20 J | tea on PES/CO |
| 20 LI | red wine on PES/CO, aged |
| 20 K | coffee on PES/CO |
| 20 JB | black currant juice on PES/CO |
| enzymatic stains | |
| 10 BMR | blood/milk/soot on CO |
| 90 PB | IEC 456 blood, aged |
| 90 MFU | milk cocoa, un-aged |
| 10 ER | egg/soot |
| 10 SG | tomato beef sauce on CO |
| EMPA 163 | porridge on CO |
| 10 PPM | pigment/vegetable oil/milk on CO |
| 10 R | starch/pigment on CO |

2. washing agents
3. washing materials

Test Method

1. The mechanically artificial soilings (monitors) and the soiled or clean laundry are added into the washing machine.
2. Add the washing agents and the water, if it is a camping washing machine
3. Carrying out washing procedure.
4. This procedure is repeated 4 times.
5. Evaluation of the Wfk-ECO-Monitors.

Measuring

1. Measure the different basis degree of whiteness Y, that means the value Y is the degree of whiteness after filtration of UV light of the light source and the deletion of the effect of the optical brightener on the laundry.
2. Take an average of the 4 Wfk-ECO-Monitors
3. Compare the different washing procedures The washing procedure according to the method of the present invention was carried out in a mechanical washer (i.e. a so-called camping washing machine or countertop washing machine) for 3 hours in a use solution comprising 1 wt.-% of composition 1 and 0.25 wt.-% of composition 2 in water. The initial temperature of the washing liquor was 18° C. which increased to 32° C. at the end of the procedure. The liquor ratio was 1:20 (1 kg textiles in 20 l washing liquor).

The washing procedure according to comparative example A was carried out in a mechanical washer (i.e. a so-called camping washing machine or countertop washing machine) in cold water for 3 hours without any chemistry. The initial temperature of the water was 18° C. and increased to 32° C. at the end of the procedure. The liquor ratio was 1:20 (1 kg textiles in 20 l washing liquor).

The washing procedure according to comparative example B was carried out in a professional Miele washing machine, using a standard disinfectant washing procedure and 6 g/l of washing composition Mop Eltra® (Ecolab), wherein a temperature of 60° C. was applied for 15 min. The total duration of the washing cycle including rinsing and spinning was 70 min. The liquor ratio was 1:5 (1 kg textiles in 5 l washing liquor).

After the washing procedure the Wfk-ECO-Monitors were measured as described above. The results are summarized in tables 3 to 5. The results show that the cleaning performance of a use solution of a floor cleaner has a good cleaning performance compared to water even if rather low temperatures are applied.

TABLE 3

| Fat Pigment Soilings | | | | | | | | |
|---|---|---|---|---|---|---|---|---|
| procedure | pigment/ lanolin on PES/CO | pigment/ sebum on PES/CO | soot/ olive oil on PES/CO | soot/ mineral oil on CO | used motor oil on PES/CO | make up on PES/CO | lip-stick on PES/CO | average |
| value of original unwashed monitor | 39.1 | 35.2 | 11.4 | 22.3 | 40.5 | 66.4 | 27.4 | 34.6 |
| comparative example A | 38.1 | 44.8 | 22.5 | 41.5 | 45.1 | 70.2 | 29.0 | 41.6 |
| comparative example B | 80.2 | 84.3 | 44.4 | 51.1 | 67.6 | 82.4 | 53.1 | 66.1 |
| inventive example | 45.1 | 78.3 | 36.3 | 63.3 | 54.7 | 82.9 | 37.9 | 56.9 |

TABLE 4

| Bleachable stains | | | | | |
|---|---|---|---|---|---|
| procedure | tea on PES/CO | red wine on PES/CO aged | coffee on PES/CO | black currant juice on PES/CO | aver-age |
| value of original unwashed monitor | 63.2 | 41.9 | 60.1 | 40.1 | 51.3 |
| comparative example A | 62.0 | 66.3 | 76.3 | 64.8 | 67.3 |
| comparative example B | 85.9 | 85.0 | 86.7 | 87.6 | 86.3 |
| inventive example | 77.2 | 79.0 | 83.6 | 81.8 | 80.4 |

TABLE 5

| Enzymatic stains | | | | | | | | | |
|---|---|---|---|---|---|---|---|---|---|
| procedure | blood/ milk/soot on CO | IEC 456 blood un-aged | milk cocoa un-aged | egg/ soot on CO | tomato/ beef sauce on CO | porrige on CO | pigment/ vegetable oil/milk on CO | starch/ pigment on CO | average |
| value of original unwashed Monitor | 16.7 | 13.4 | 38.5 | 22.2 | 48.3 | 47.3 | 44.2 | 41.4 | 34.0 |
| comparative example A | 35.2 | 60.9 | 63.0 | 46.6 | 66.0 | 70.3 | 55.9 | 63.5 | 57.7 |
| comparative example B | 35.9 | 84.1 | 54.1 | 47.7 | 84.5 | 67.6 | 68.9 | 51.7 | 61.8 |
| inventive example | 32.6 | 54.7 | 65.5 | 48.3 | 80.5 | 75.9 | 66.0 | 64.4 | 61.0 |

The invention claimed is:

1. A method of manual surface cleaning comprising:

a) applying a first use solution of a first detergent composition to a cleaning textile, wherein the first detergent composition is a liquid detergent concentrate comprising a surfactant system and a source of alkalinity, the first detergent composition having a pH between 11 and 14;

b) wet wiping a surface with the cleaning textile wetted with the use solution of the first detergent composition; thereafter c) washing the cleaning textile in a portable or countertop washing machine using a second use solution of the first detergent composition and a preserving agent for at least one washing cycle, the washing machine comprising:

a container for the second use solution and preserving agent;

a hose for removing used washing liquid from the container;

an electrical connection; and an automated mechanical agitator, wherein the washing machine does not exceed 15 kg; and thereafter d) wet wiping a surface with the cleaning textile, wherein the cleaning textile is not subjected to a drying step after the previous washing.

2. The method according to claim 1, wherein the first use solution and the second use solution have different concentrations.

3. The method according to claim 1, wherein the first use solution and the second use solution have the same concentration.

4. The method according to claim 1, wherein the preserving agent is chosen from amines, quaternary ammonium compounds, aldehydes, antimicrobial acids and salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolones, bleaching agents or bleaching compositions and mixtures thereof.

5. The method according to claim 1, wherein the washing machine has a maximum load of 2.0 kg dry weight.

6. The method according to claim 1, wherein the washing is carried out at a temperature in a range from 5 to 45° C.

7. The method according to claim 1, wherein the washing is carried out for 0.5 to 4 hours.

8. The method according to claim 1, wherein the surfactant is selected from the group consisting of nonionic surfactants, anionic surfactants, zwitterionic surfactants, amphoteric surfactants, and combinations thereof.

9. The method according to claim 1, wherein the surface which is cleaned is a floor.

10. The method according to claim 1, wherein the first detergent composition further comprises additional ingredients selected from the group consisting of soil release agents, anti-redeposition agents, enzymes, enzyme stabilizers, defoaming agents, optical brighteners, preserving agents, chelating agents, sequestrants, and mixtures thereof.

* * * * *